US010307687B2

(12) United States Patent
Umberger

(10) Patent No.: US 10,307,687 B2
(45) Date of Patent: Jun. 4, 2019

(54) FINGER MANIPULATED DEVICE

(71) Applicant: Cody Umberger, Oak Ridge, NJ (US)

(72) Inventor: Cody Umberger, Oak Ridge, NJ (US)

( * ) Notice: Subject to any disclaimer, the term of this patent is extended or adjusted under 35 U.S.C. 154(b) by 0 days.

(21) Appl. No.: 15/913,230

(22) Filed: Mar. 6, 2018

(65) Prior Publication Data

US 2019/0099688 A1 Apr. 4, 2019

Related U.S. Application Data

(60) Provisional application No. 62/567,124, filed on Oct. 2, 2017.

(51) Int. Cl.
*A63H 33/26* (2006.01)
*A63H 5/00* (2006.01)

(52) U.S. Cl.
CPC ..... *A63H 33/26* (2013.01); *A63H 5/00* (2013.01)

(58) Field of Classification Search
CPC ..... A63H 5/00; A63H 33/26; A63H 33/046; A63F 9/34
USPC ..... 446/132, 133, 134, 135, 137, 138
See application file for complete search history.

(56) References Cited

U.S. PATENT DOCUMENTS 4,012,038 A * 3/1977 Brotz ..... A63H 33/26 273/456
8,327,518 B2 * 12/2012 Korner ..... A61B 1/0055 138/120
8,764,509 B1 * 7/2014 Lytle ..... A63H 1/30 446/250
2017/0050116 A1 * 2/2017 Shlomot ..... A63H 1/30

* cited by examiner

*Primary Examiner* — Vishu K Mendiratta
(74) *Attorney, Agent, or Firm* — Dean A. Craine, P.S.

(57) ABSTRACT

A finger manipulated device that gives the user a unique tactile and audible sensations comprising of two, disc-shaped shells, a first and second set of magnets located on the inside surfaces of each shell, and flat thrust bearing disposed between the shells. The magnets in the first set and second set are aligned in circular arrays. The magnets in each array are aligned in the same direction and evenly space apart. The thrust bearing includes a thin frame with a plurality of rollers radially aligned that fit into two raceways formed on the inside surfaces of the two shells. The thrust bearing supports the two shells and holds them apart. When assembled, the two shells are held together on opposite sides of the thrust bearing by magnetic forces created by the two sets of magnets and produce unique tactile and sound sensations when the shells are rotated back and forth in alternating directions with the user's fingers.

6 Claims, 8 Drawing Sheets

FINGER MANIPULATED DEVICE

This application is based on and claims the filing date benefit of U.S. provisional patent application (Application No. 62/567,124) filed on Oct. 2, 2017.

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

Field of the Invention

This invention pertains to handheld finger manipulation devices, also known as finger fidgeting devices, that are held in the hand and manipulated by repeatedly moving the tips of the fingers back and forth back between the two fingers.

Finger manipulation devices, known as 'fidget spinners', are popular toys that operate like mini-gyroscopes. They comprise two or three lobes that extend radially from a ball-bearing center hub. During use, the user positions the index or middle finger under the hub and holds the hub stationary and then applies a force or torque to one lob causing the device to spin. The way the device spins with minimal friction, the speed of rotation, how long the device spins, and its resistance to movement while spinning caused by the Law of Conservation of Angular Momentum, makes the device very interesting.

Other types of finger manipulating devices are needed that exploit the common movements of an individual fingers, such as the back and forth rubbing movement of the index finger and the thumb. Such devices that also provide unique tactile and audible sensations to the user would also be desirable.

SUMMARY OF THE INVENTION

A compact, dual finger manipulated device comprising a disc body that includes a first shell, a second shell, a first circular magnetic element in the first shell, a second circular magnetic element in the second shell, and a circular, flat thrust bearing between the two shells. The first and second shells are stacked and held between two fingers on one hand. Disposed between the two shells is a low friction thrust bearing that includes a plurality of radially aligned rollers. The thrust bearing is retained in circular recessed raceways formed on the inside surfaces of the two shells. The rollers have sufficient diameters, so a small gap is formed between the two shells which allows them to rotate independently in opposite directions.

In a first embodiment, the first circular magnetic element includes a plurality of disc magnets in the first set of magnets are aligned in a circular array on the inside surface of the first shell. The disc magnets in the first set of magnets are held in a fixed position and evenly spaced apart. In the embodiment shown herein, the disc magnets are inserted into magnet bores formed on a coaxially aligned, raised platform. Disposed around the raised platform is a recessed circular raceway that receives the thrust bearing. The disc magnets are aligned so their longitudinal axes are parallel to the first shell's longitudinal axis. The magnets are also aligned so their N-poles face the same direction.

On the inside surface of the second shell is a second circular magnetic element comprising a plurality of disc magnets also arranged in a circular array, in the embodiment shown herein, the circular array is also formed on a coaxially aligned, raised platform. Disposed around the raise platform is a recessed, circular raceway that receives the thrust bearing. When the two shells are stacked together, the raceways are aligned and retain the thrust bearing.

The raised platform and the circular raceway on the second shell are identical to the platform and circular raceway used on the first shell. The quantity and placement of the magnets on the second set of magnets are identical to the quantity, and placement of the magnets on the first set of magnets. Like the magnets in the first set of magnets, the magnets in the second set of magnets are spaced apart at the same distances with their longitudinal axes parallel to the device's longitudinal axis. The disc magnets are also oriented with their N-poles facing the same direction. When the two shells are stacked to form the disc body, the S-poles of the disc magnets used on the first set of magnets are near the N-poles on the disc magnets used on the second set of magnets so magnetic attractive forces are produced between them.

Formed on the center axis of the first and second shells are axially aligned finger bores. During use, the finger bores denote the location of the longitudinal axis of the shells and the locations where the tips of the fingers may be placed when manipulating the device. Also, formed on the outside surface of the first and second shells are finger gripping elements that enable the user to more easily rotated or impart torque to one or both shells using the tips of the fingers.

When assembled, the two shells, the two finger bores and the circular raceways are stacked and coaxially aligned. The rollers on the thrust bearings are retained in the circular raceways. The disc magnets on the first and second set of magnets are aligned with the disc body's longitudinal axis. When assembled, the shells automatically rotate so the disc magnets on the first and second shells align. The disc magnets on the two sets of magnets are placed so they do not physically contact but are sufficiently close to produce magnetically attractive forces that hold the two shells together.

During use, the shells are held between two fingers on one hand. The one finger is placed on the outer surface of one shell while the other finger is placed over the outer surface of the other shell. The user may keep one finger stationary and move the other finger to impart rotation of one shell while holding the other shell stationary. Alternatively, the user may impart rotation on both shells in opposite directions. The user may move the shells in the same direction or may move one or both fingers in a back and forth in alternating directions.

When the device is operated in the hand, a unique tactile sensation is produced. When one shell rotates over the other or as both shells rotate over each other in the opposite directions, the disc magnets on the first and second sets are repeatedly aligned and misaligned. When the disc magnets in the first and second sets approach alignment, the attractive forces between the disc magnets gradually increases causing the two shells to rapidly rotate until they are axially aligned. Because the magnets are axially aligned, further rotation of the first and second shells is impeded. Greater force must be applied by the fingers to overcome the attractive forces and rotate one shell over the other shell or to rotate both shells in opposite directions. As rotation continues, the magnetic forces between previously aligned magnets weaken, and less force is required to move rotate the shells. Eventually, a slight repulsion force is created between the sets of magnets causing them to separate and increase the gap between their adjacent edges. As the shells are further rotated, the disc magnets approach alignment with a new magnet and the attractive forces increase. When the magnets on the two sets are realigned, the two shells are forced together and 'clap' against the thrust bearing creating an audible and tactile 'click'.

In a second embodiment, the first and second arrays each with a plurality of disc magnets are replaced two cylindrical washer magnets with their poles oriented in opposite directions. The washer magnets are aligned in the shells, so their N-S poles are aligned in the same direction. During use, the shells are moved back and forth in opposite directions, only the tactile sensation is produced.

DESCRIPTION OF THE PREFERRED EMBODIMENT(S)

Figure 1:
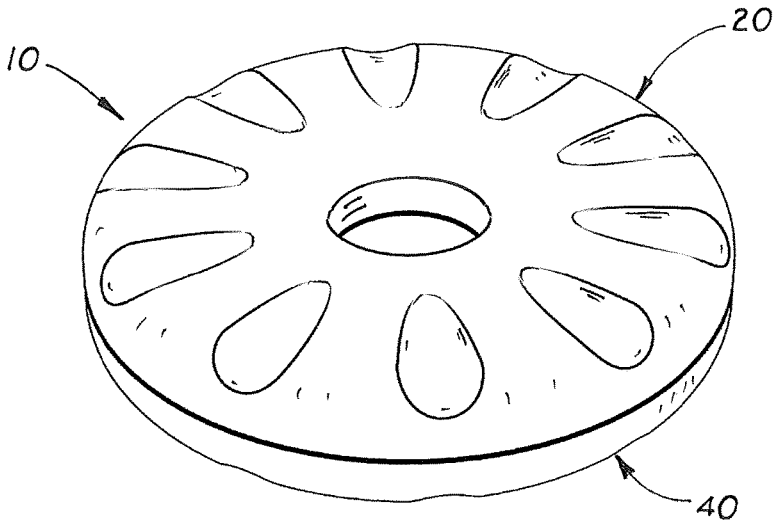
FIG. 1 is a top perspective view of the finger manipulated device described herein.
Figure 2:
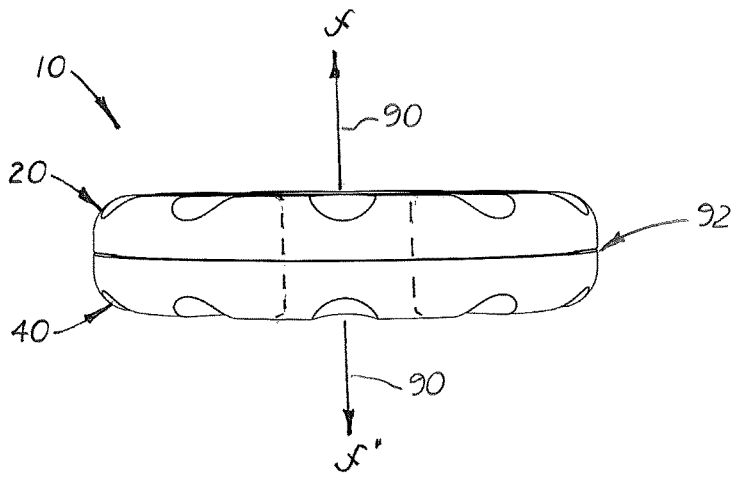
FIG. 2 is a side elevational view of the device shown in FIG. 1.

A handheld finger manipulated device 10 comprising a disc body 15 made of two disc-shaped shells 20, 40, a thrust bearing 50, and a first and second sets of magnets 60, 70. Each set of magnets 60, 70 includes a plurality of disc magnets 80, 85 mounted on the inside surface 21, 41 of the first and second shells 20, 40, respectively. In the embodiment shown, the disc magnets 80, 85 in each set 60, 70, respectively, are inserted into cylindrical magnet holes 28, 48 arranged in a circular array or pattern on the outside surface of a raised platform 27, 47 formed on the inside surface 21, 41 on the shells 20, 40, respectively. The disc magnets 80, 85 are oriented with their N poles all facing the same direction.

Figure 3:
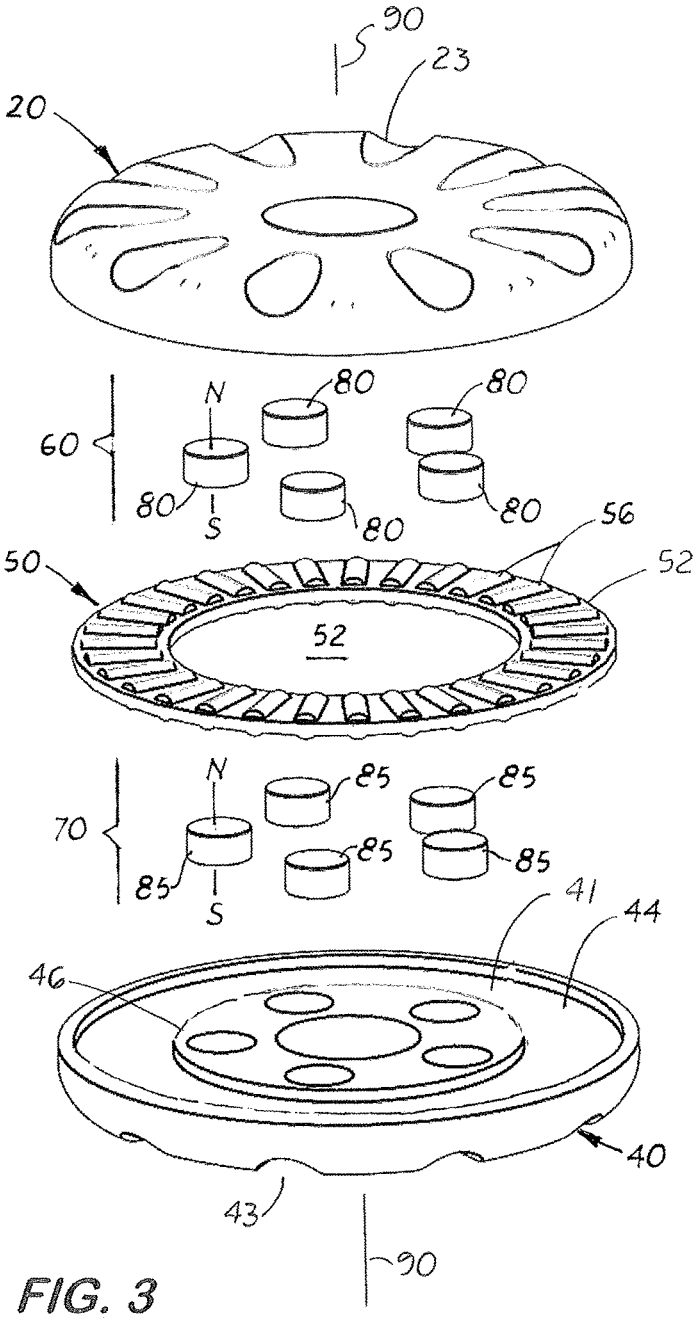
FIG. 3 is an exploded view of the device shown in FIG. 1.

The second shell 40 contains an inner surface 41 in which a second set of disc magnets 70 are also arranged in a circular array or pattern of magnet bores 48 formed on the raised platform 47. The diameters of the two circular arrays on the raised platforms 27, 47 are identical. The second set of disc magnets 85 has the same number of magnets and the same size disc magnets used in the first set of disc magnets 60. The disc magnets 85 in the second set of disc magnets 70 are spaced apart in the same distances with their longitudinal axes parallel to the device's longitudinal axis 90, and arranged so their N poles face the same direction. The N poles of the disc magnets 85 in the second set of disc magnets 70 face the S poles of the disc magnets 80 used on the first set of magnets 60 when the two shells 20, 40 are coaxially aligned and joined, (see FIG. 3).

A thrust bearing 50 is placed between the two shells 20, 40. The thrust bearing 50 includes a flat, ring-like frame 52 and a plurality of radially aligned rollers 56. Formed in the center of the frame 52 with a center opening 54. During assembly, the frame 52 fits into the raceways 24, 44 formed around the raised platforms 27, 47, respectively. The raised platforms 27, 47 partially extend into the center opening 54. Each shell 20, 40 includes an outer raised perimeter lip 22, 42 that surrounds the circular raceways 24, 44. The diameters of the rollers 56 are sufficient to press against the inside surfaces of the raceways 24, 44 and hold the shells 20, 40 apart. A gap 92 is formed between the perimeter lips 22, 42.

The frame 52 and rollers 56 on the thrust bearing 50 are sufficiently narrow and short, respectively, so that the entire thrust bearing 50 may rotated inside the raceways 24, 44.

Figure 4:
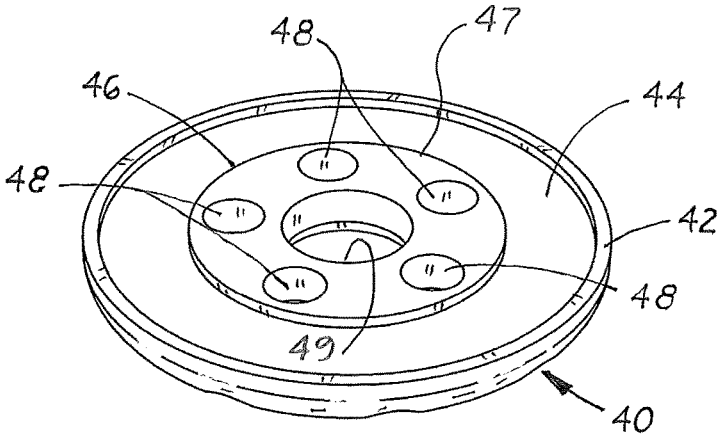
FIG. 4 is a top perspective view of second shell showing the inside surface.
Figure 5:
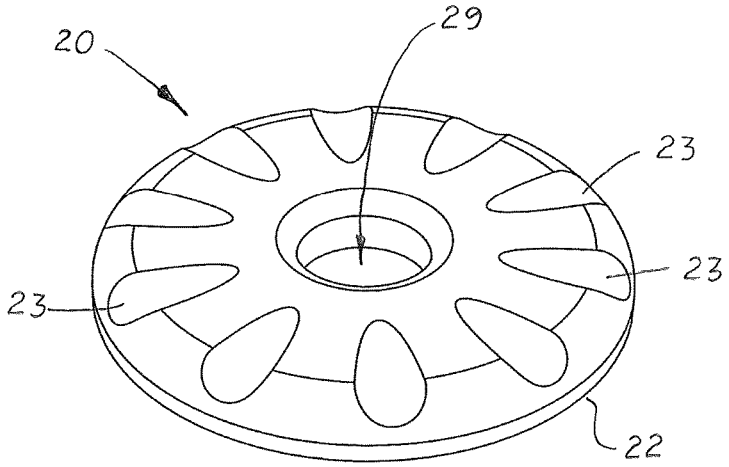
FIG. 5 is a top perspective view of the first shell showing the outside surface.
Figure 6:
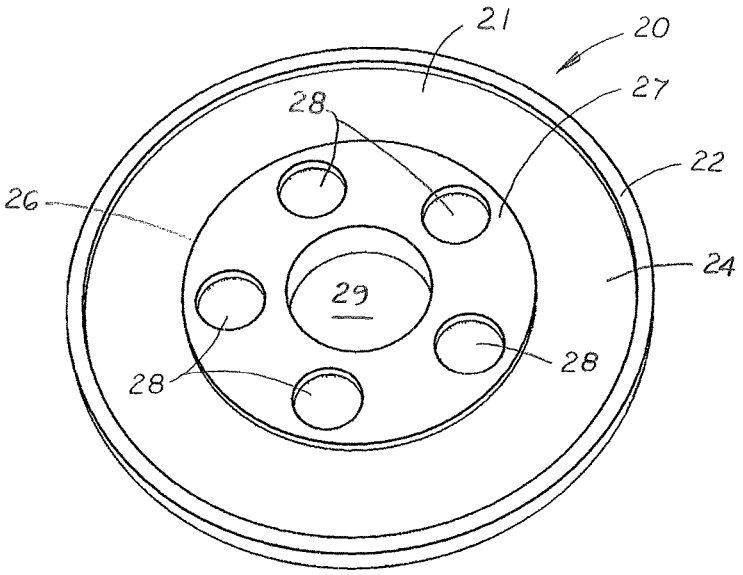
FIG. 6 is a bottom perspective view of the first shell.

Formed on the center axis 23, 43 of the first and second shells 20, 40, respectively, are axially aligned finger bores. 29, 49, (see FIGS. 4 and 5). The bores 29, 49 may extend fully or partially through the shells 20, 40. Also, former the outside surface of the first and second shells 20, 40 are finger gripping elements 29 that enable the user to more easily rotated or impart torque to one or both shells using the tips of the fingers.

When assembled, the two shells 20, 40, the two finger bores 29, 49, and the circular raceways 24, 44 are coaxially aligned. The rollers 56 on the thrust bearing 50 are positioned in the two circular raceways 24, 44. A small gap 92 is formed between the two shells 20, 40. When the two shells 20, 40 are stacked and coaxially aligned, the ends of disc magnets 80, 85 on the two sets of magnets 60, 70, respectively, are slightly spaced apart so they do not physically contact. The adjacent ends of the disc magnets 80, 85 on the first and second sets of magnets 60, 80, respectively, are sufficiently close so the disc magnets 80 on the first set of magnets 60 on the first shell 20 are magnetically attracted to the disc magnets 85 on the second set of magnets 70 on the second shell 40 to hold the two shells 20, 40 together.

During use, the user uses two digits (e.g. the thumb and index tinge to rotate the two shells 20, 40 in opposite directions or to hold one shell stationary and rotate the opposite shell around a central axis 90. When at rest, the two shells 20, 40 are held together and resist rotation when the disc magnets 80, 85 in the two sets of magnets 60, 70, respectively, are axially aligned. When sufficient opposing external forces are applied to the shells 20, 40, they rotate around the center axis 90. During the rotation, the N and S poles of the disc magnets 80, 85 become off-set and the magnetic forces holding the two shells 20, 40 together are reduced. The gap 92 between the two shells 20, 40 may widen. When the disc magnets 80, 85 approach re-alignment, the attractive forces between the disc magnets 80, 85 gradually increases causing the two shells 20, 40 to rapidly rotate until the disc magnets 80, 85 are aligned. When aligned, further rotation of the first and second shells 20, 40 is resisted. Greater force must be applied by the fingers to overcome the attractive forces to rotate one shell over the other shell or to rotate both shells in opposite directions. As rotation continues, the magnetic forces repeatedly increase and weaken causing unusual acceleration and deacceleration of the two shells.

FIGS. 7-10, discloses a second embodiment of the device indicated by reference number 110 in which the first and second set of disc magnets 60, 70 are replaced two, flat washer magnets 160, 170, respectively. The device 100 includes two shells 120, 140 separated by the thrust bearing 50. The washer magnets 160, 170 have N-S poles oriented on opposite sides. The washer magnets 160, 170 are cylindrical and fit into two recessed, circular raceways 124, 144 formed on the inner surfaces 121, 141, respectively, of the first shell 120 and second shell 140.

Figure 7:
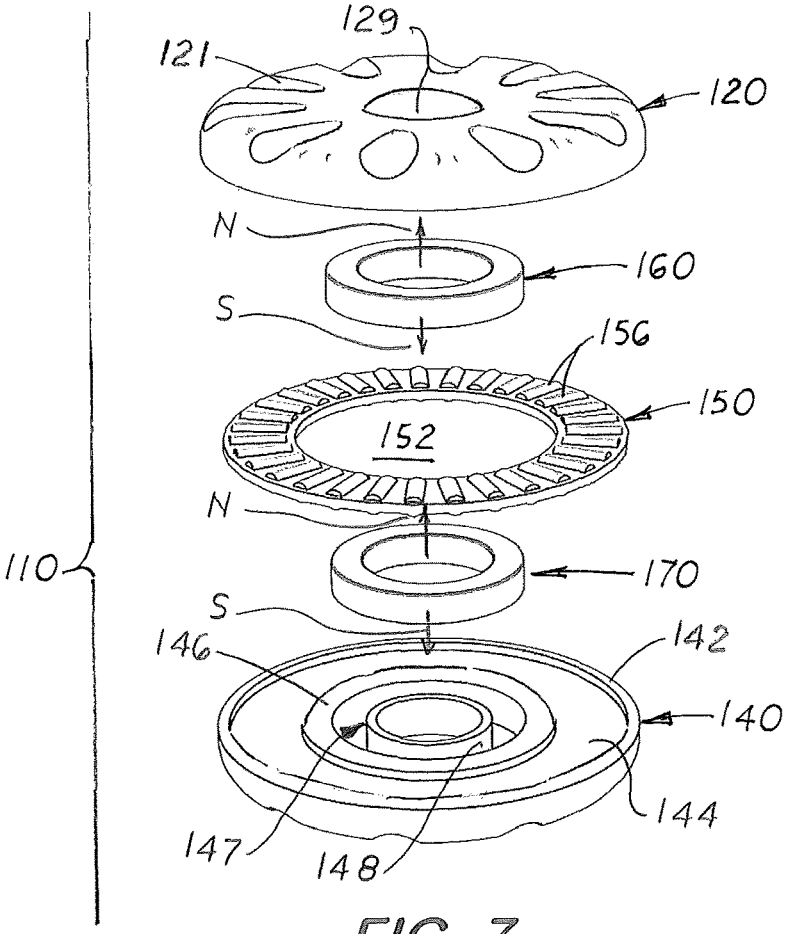
FIG. 7 is an exploded view of a second embodiment of the finger manipulated device that uses two washer magnets.
Figure 8:
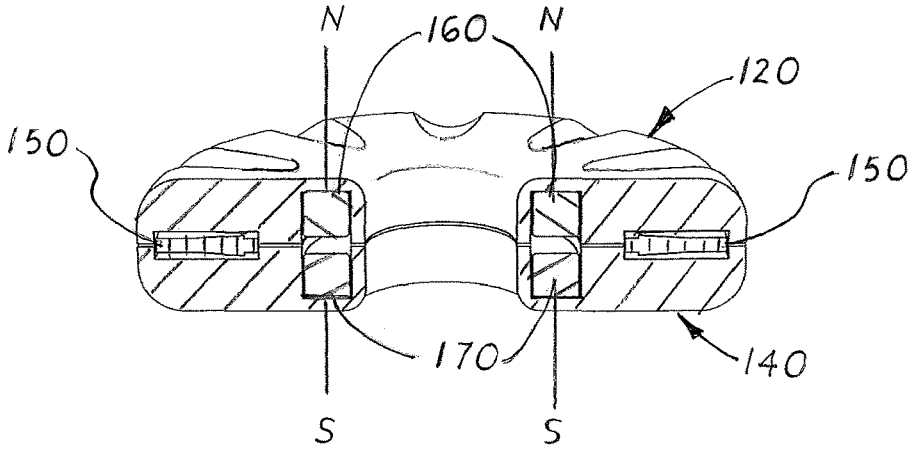
FIG. 8 is a sectional, side elevational view of the second embodiment shown in FIG. 7.
Figure 9:
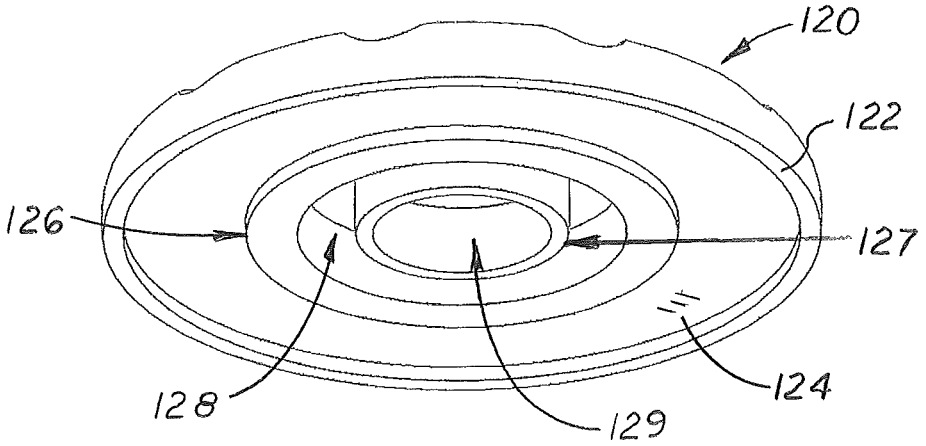
FIG. 9 is a second perspective of the first shell used on the second embodiment.
Figure 10:
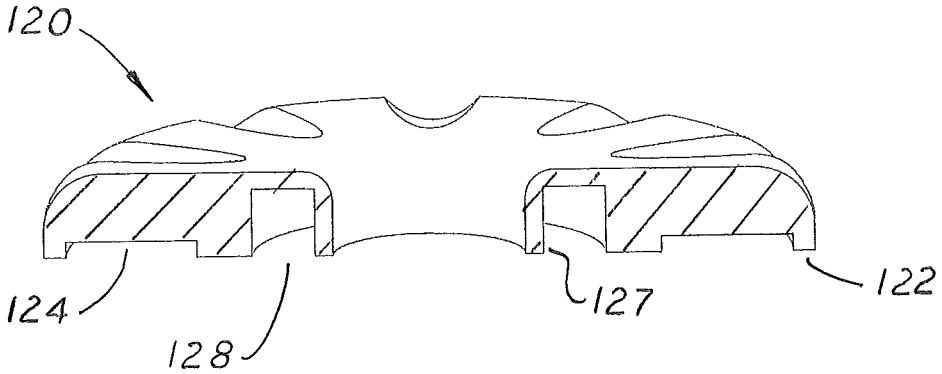
FIG. 10 is a sectional, side elevational view of the first shell used on the second embodiment shown in FIG. 9.

Located inside the circular raceways 124, 144 are hollow necks 127, 147. Disposed around the circular raceways 124, 144 is a circular raised platform 126, 146. The magnets 160, 170 are oriented in the raceways 124, 144 so their N poles and the S poles face the same direction as shown in FIGS. 7 and 8. Located inside the circular raceways 124, 144 are cylindrical raised platform 126, 146. Formed around the circular raceways 124, 144 is a raised perimeter lip 122, 142.

When assembled, the two shells 120, 140, the two finger bores 129, 149 and the circular raceways 124, 144 are coaxially aligned. The rollers 56 on the thrust bearing 50 are positioned between the circular raceways 124, 144. The thrush bearing 50 includes a thin ring 52 with a plurality of radially aligned rollers 56. The rollers 156 hold the two shells 120, 140 apart and form a small gap 192 that enables the two shells 120, 140 to rotated independently. When the two shells 120, 140 are stacked and coaxially aligned, the ends of washer magnets 160, 170 are sufficiently spaced apart so they do not physically contact. The S pole on the first washer magnet 120 is close to N pole on the second washer magnet 140 to hold the two shells 120, 140 together.

During use, the user uses two digits (e.g. the thumb and index finger) to rotate the two shells 120, 140 in opposite directions or to hold one shell stationary and rotate the opposite shell around a central axis 190. The magnetic attractive forces between the two washer magnets 160, 170 hold the two shells 120, 140 together. Unlike the first embodiment, two shells 120, 140 rotate smoothly over each other without the acceleration, deacceleration and resistant experienced with the first embodiment.

In the embodiments shown in the Figs, each disc body 15, 115 when assembled measures approximately 41 mm in diameter and approximately 9 mm thick. Each shell 20, 40, 120, 140 is made of metal and approximately 4 mm thick and the finger bores 29, 49 are approximately 11 mm in diameter. The circular frame 52 used on the thrust bearing 50 is approximately 40 mm in diameter and approximately 2 mm thick. The diameter of the inner opening formed on the circular frame 52 is approximately 26 mm in diameter. Each roller 56 is approximately 2 mm in diameter and approximately 5 mm in length.

Each set of magnets 60, 70 includes five-disc magnets 80, 85, respectively, aligned approximately 72 degrees apart. Each disc magnet 80, 85 is approximately 4.4 mm in diameter and 2 mm in length. When two disc magnets 80, 85 are axially aligned, they generated a pull force between 1.20 and 1.26 lbs. In the embodiment, shown herein the pull force is approximately 1.23 lbs. The magnet bores 28, 48 are approximately 3 mm in length so the exposed end of the magnet when placed inside the bore is recessed approximately 1 mm. Each raised platform 26, 46 is approximately 25 mm in diameter and extends approximately 1 mm above the top surface of the surrounding raceway 24, 44.

The washer magnets 160, 170 have an outside diameter of approximately 25 mm and an inside diameter of approximately 10 mm. The washer magnets 160, 170 are approximately 2 mm in length, (i.e. Y-axis). When the washer magnets 160, 170 are axially aligned, they produce a pull force of approximately 7.27 lbs.

In the embodiment shown in the Figs, the frame 52 is made of magnetically attracted metal.

When the two shells 20, 40 and 120, 140 are stacked, the gap 92, 192 formed between the two shells 20, 40 and 120, 140, respectively, is approximately 0.5 mm.

I claim:

1. A handheld finger manipulated device, comprising:

a. disc body that includes a first shell and a second shell, the first and second shells each include a longitudinal axis and an inside surface, the first and second shells are coaxially aligned;

b. a circular thrust bearing located between the first shell and the second shell, the trust bearing includes a flat ring frame with a plurality of radially aligned rollers aligned therein and a center opening, the rollers are sufficient in diameter to roll against the inside surfaces of the first shell and the second shell when the first and second shells are coaxially aligned and stacked;

c. a first set of disc magnets attached to the inside surface of the first shell, the first set of disc magnets being aligned in a circular array with their N-S poles oriented in the same direction, the disc magnets in the first set of disc magnets being affixed to the first shell and located over the center opening on the thrust bearing;

d. a second set of disc magnets attached to the inside surface of the second shell, the disc magnets in the second set of magnets being aligned in a circular array with their N-S poles arranged in the same direction and in the same direction as the disc magnets in the first set of disc magnets, the disc magnets in the second set of magnets being affixed to the second shell and located over the center opening on the thrust bearing; and e. whereby when one shell is rotated over the other shell or when the two shells are rotated in opposite directions, the disc magnets on one shell repeatedly travel over the disc magnets of the other shell, the disc magnets on the first and second shells are repeatedly aligned to produce maximum magnetic attractive forces and thereby resist rotation of one or both shells, and misaligned to produce reduced magnetic attractive forces enabling one or both shells to rotate more freely.

2. The finger manipulated device, as recited in claim 1, further including a recessed circular raceway formed on the inside surface of each shell configured to receive the thrust bearing.

3. The finger manipulating device, as recited in claim 1, further including a raised platform formed on the inside surface of each said shell on which said disc magnets are amounted.

4. The finger manipulated device, as recited in claim 1, wherein the disc magnets have sufficient magnetism to produce approximately 1.2 to 1.26 lbs. of pull force when the disc magnets on the first and second disc are axially aligned.

5. The finger manipulating device, as recited in claim 1, further including coaxially aligned finger bores formed on each shell.

6. The finger manipulating device, as recited in claim 1, further including Also, finger gripping elements formed on the outside surface of each shell that enable a user to more easily rotated or impart torque to one or both shells using the tips of the fingers.

* * * * *